United States Patent [19]

Dunn et al.

[11] 4,206,852

[45] Jun. 10, 1980

[54] LINERLESS CLOSURE FOR PRESSURIZED CONTAINER

[75] Inventors: Lloyd G. Dunn; Elmer E. Pohlenz, both of Richmond, Ind.

[73] Assignee: Aluminum Company of America, Pittsburgh, Pa.

[21] Appl. No.: 6,597

[22] Filed: Jan. 26, 1979

[51] Int. Cl.[2] ..... B65D 41/34

[52] U.S. Cl. ..... 215/252; 215/270; 215/307; 215/354

[58] Field of Search ..... 215/252, 260, 270, 307, 215/329, 320, 354

[56] References Cited

U.S. PATENT DOCUMENTS

| | | | |
|---|---|---|---|
| 3,110,411 | 11/1963 | Golde | 215/329 |
| 3,209,934 | 10/1965 | Salminen | 215/320 |
| 3,595,418 | 7/1971 | Adcock | 215/329 |
| 3,673,761 | 7/1972 | Leitz | 215/252 X |

FOREIGN PATENT DOCUMENTS

| | | | |
|---|---|---|---|
| 670896 | 9/1963 | Canada | 215/260 |

*Primary Examiner*—Donald F. Norton
*Attorney, Agent, or Firm*—David W. Brownlee

[57] ABSTRACT

A linerless plastic closure is disclosed which is adapted to seal containers for pressurized contents such as carbonated beverages and which utilizes a plug configuration that is designed to expand under pressure. This is accomplished by making the plug in the form of a disc spring washer with tubular supports joining it to the top of the closure. Pressure against the disc spring washer increases the pressure of the seal against the interior surface of the bottle mouth to provide a reliable seal. The closure may have a slot through the threads on the closure to permit rapid escape of gases from the container during removal of the closure from the container. In this way, dangerous blow-off of the closure from a container is substantially eliminated.

11 Claims, 4 Drawing Figures

LINERLESS CLOSURE FOR PRESSURIZED CONTAINER

BACKGROUND OF THE INVENTION

1. Field of Art

This invention relates to caps or closures for containers and in particular to a linerless plastic closure which is adapted to seal containers having internal pressure therein.

2. Brief Description of the Prior Art

Closures for liquid-carrying containers, particularly those closures for application on carbonated beverage bottles, have been predominately metal with a resilient liner incorporated therein to properly effect a seal. The necessity of providing a liner has added to the cost, and there is a need and desire for a one-piece closure that will function as an effective seal after engagement with the bottle.

As desirable as the one-piece plastic closure may be, there are a number of problems associated with its use. First is the problem of maintaining a seal over an extended period of time under various conditions of packing, storage and handling. Plastic materials have an inherent tendency to cold flow or creep under stress; thus, once the closure is firmly engaged on the container, whether by threads or some other means, various parts of the closure are under stress because of forces required to effect a seal. This is particularly true when the container is used to package carbonated beverages, and internal pressure acts outwardly on the closure. A plastic material's tendency to creep is further affected by elevated temperatures. The problem created by creep is to cause a loss of seal, and, as a result, a possibility of leakage or spoilage of the contents.

In order to achieve an effective seal with a one-piece closure, various means have been employed. Plunkett U.S. Pat. No. 3,055,526, Healy U.S. Pat. No. 3,160,303, Gibson U.S. Pat. No. 3,232,470 and Braun U.S. Pat. No. 3,255,908, to cite a few, have relied upon the sealing action to take place on the uppermost face of the container opening. Others, such as Miller U.S. Pat. No. 3,074,579, Fox U.S. Pat. No. 3,142,402, Grussen U.S. Pat. No. 3,462,035, Landen U.S. Pat. No. 3,741,424 and Salminen U.S. Pat. No. 3,209,934 depend at least in part for a seal on an annular wall descending from an upper end wall on the cap, and said annular wall impinging against the inside surface of the container neck. The annular wall in a closure of this type functions as a plug, and the effectiveness of the seal relies upon an interference fit between the plug and the inside of the container neck.

A problem with the performance of either of the two aforesaid types of closures relates to manufacturing tolerances on the container. The manufacturing tolerances are broad; the inside diameter of the neck can vary to such an extent that there may be too much interference between the plug and the container opening or there may be so little interference that an effective seal cannot be made; likewise, the top face of the rim on the neck of the container and the inside of the neck may be rough or uneven and thus have an adverse effect on the seal.

Another inherent problem with the use of closures for pressurized containers, and especially those closures utilizing plug seals, is that of "blow-off" or, as it is sometimes called, "closure missiling". On a threaded closure, the cap must be unscrewed to the point where pressure is released while sufficient thread engagement remains to keep the closure from being propelled from the bottle. There is no control over the method used to unscrew the closure in that the consumer effects such unscrewing. The method varies from repeated twisting actions in the range of 90° rotation each to 360° rotation in one twist. Any combination of these is possible. Release of pressure therefore should be as near instantaneous as possible to eliminate problems associated with different opening techniques. U.S. Pat. No. 4,007,851 discloses a solution to the "closure missiling" problem as it pertains to rolled-on metal closures. U.S. Pat. No. 2,990,079 shows a one-piece threaded plastic closure that employs a gas-venting means, and U.S. Pat. No. 3,994,104 discloses a threaded wine bottle stopper comprising a one-piece threaded cap and plug having a gas-venting means.

Accordingly, a linerless plastic closure is desired that cooperates with bottles made by different manufacturers which will provide a reliable seal on glass or plastic containers for pressurized liquids and will minimize the chance of accidental "blow-off" during removal of the closure from its container.

Although the majority of the experimental and developmental work on the present invention was directed toward using the closure with a plastic container, it is believed that the closure is suitable for glass containers as well.

SUMMARY OF THE INVENTION

In its preferred embodiment, this invention provides a linerless plastic closure for threaded engagement on a container, said closure having a plug seal with a disc spring washer which is an integral part of the closure and is adapted to provide increased sealing pressure against the interior surface of a container neck in response to internal pressure within the container, as will be explained in greater detail hereinafter. Since a closure of this invention does not rely solely on an interference fit with the interior surface of the container neck to effect a seal, dimensional variations and surface irregularities in the bottle are compensated for by the unique plug seal of this closure.

A closure of this invention may further include a slot or slots through the threads on the interior surface of the closure skirt to vent gases from the container during removal of the closure from a container. In this way dangerous blow-off of the closure is prevented.

A closure of this invention may also include means for making the closure pilfer proof.

An object of this invention is to provide an improved linerless plastic closure capable of sealing pressurized containers such as containers of carbonated beverages. Another object of this invention is to provide a closure with a plug seal and including means for preventing blow-off of the closure during removal from a container. A further object of the invention is to provide a linerless plastic closure which will not be adversely affected by creep or cold flow of plastic during storage of a container. Another object of this invention is to provide a one-piece plastic closure that will cooperate with bottles made by different manufacturers without the necessity of constructing separate closure molds for each manufacturer's bottle.

The above and other objects and advantages of this invention will be more fully understood and appreciated with reference to the following description and drawings, and it will be apparent to those skilled in the art that this invention will function as an effective closure on a non-pressurized as well as a pressurized container.

BRIEF DESCRIPTION OF THE DRAWINGS

A preferred embodiment of the invention has been chosen for purposes of illustration and description as follows.

DESCRIPTION OF A PREFERRED EMBODIMENT

If a closure of this invention is made with an attached pilfer-proof means, high density polyethylene is the preferred material; for embodiments not requiring a pilfer-proof means, the preferred plastic material for the closure is polypropylene.

Although high density polyethylene and polypropylene are the preferred materials in the aforesaid embodiments, this closure can be made of other plastic materials.

Figure 1:
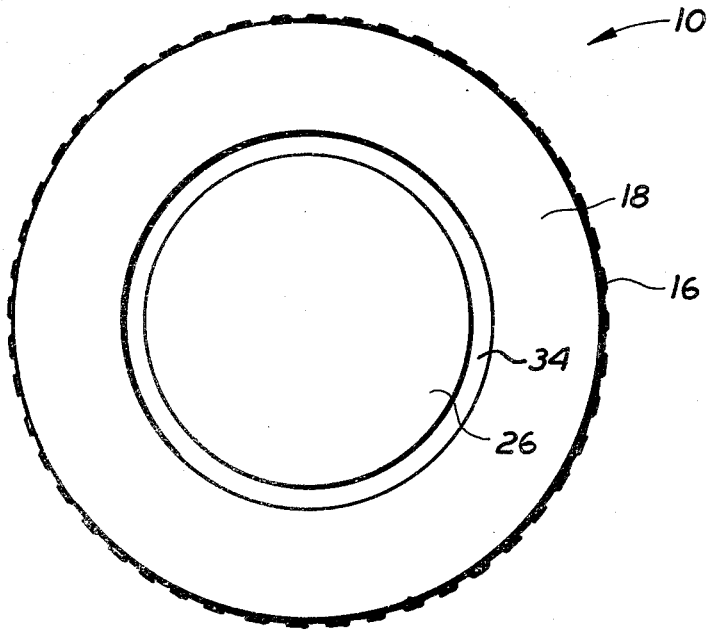
FIG. 1 is a top plan view of a closure of this invention.
Figure 2:
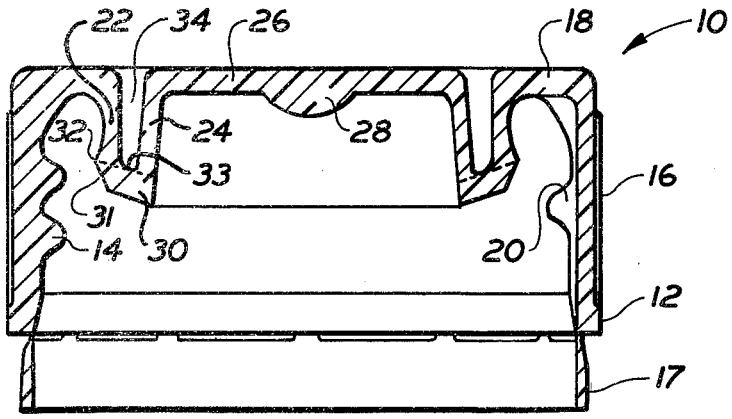
FIG. 2 is a cross section through the closure of FIG. 1 in an unsealed position.

Referring now to FIGS. 1 and 2, a closure of this invention 10 comprises a cap and a plug integrally combined. A skirt wall 12 having threads 14 on its interior surface, knurls 16 on its exterior surface and pilfer-proof means 17 attached to the bottom of the outer surface, and said skirt wall 12 extending downwardly from an annular end wall 18 comprise the cap portion of the closure. Portions of the skirt wall 12 define a gas vent slot 20 that will be explained in greater detail hereinafter. Typically, the thread 14 on a 28 mm closure as illustrated extends continuously for 504° in circumferential length with a spacing in a vertical direction of eight threads per inch. It would be obvious that a closure of this invention is not limited to any particular thread length or spacing. The plug portion of the closure 10 comprises a first cylindrical wall 22 extending downwardly from the annular end wall 18, a second cylindrical wall 24 projecting downwardly, and preferably outwardly from a circular end wall 26 which has a hemispherically shaped dome 28 projecting downwardly from its interior surface, and an annular wall 30 approximately 0.060 inch wide extending downwardly and inwardly from the first cylindrical wall 22 to the second cylindrical wall 24. The outer circumferential face 31 of the annular wall 30 is beveled at a vertical angle of approximately 20° to provide a proper lead into the neck of a bottle. Portions of the first cylindrical wall 22 and the annular wall 30 define an outwardly projecting sealing wedge 32. The annular wall 30 functions as a disc spring washer as will be described in greater detail hereinafter. The combination of the first cylindrical wall 22, the annular wall 30 and the second cylindrical wall 24 defines an annular gap 34.

Figure 3:
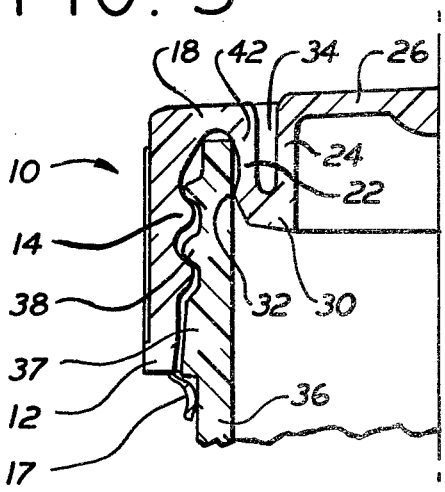
FIG. 3 is a partial cross section through the closure of FIG. 1 in a sealed position on a plastic bottle under internal pressure.

To accomplish the purposes of this invention, several dimensions and measurements of parts of this embodiment are important, as will now be explained. Referring to FIG. 3, half of the closure 10 is shown in a sealed position on a section of the neck 36 of a bottle under internal pressure. The threads of the bottle 38 cooperate with the threads 14 of the closure 10, and the annular sealing wedge 32 presses tightly against the inner surface of the bottle neck 36 as a result of the combination of the interference fit between the bottle neck 36 and the closure 10 and the internal pressure acting outwardly on the interior surfaces of the closure 10. After screwing the closure into the closed position, as shown, a heating means is applied to pilfer-proof means 17 causing said pilfer-proof means to deform and press tightly against the exterior of the bottle neck 36. The outer diameter of the annular sealing wedge 32 of a typical 28 mm beverage closure of this invention is 0.880 inch. The typical inside neck diameter of a plastic bottle to cooperate with this closure is 0.859 inch. It can be seen that the effect of screwing the closure, as described, on the bottle, as described, is to create an interference fit between the annular sealing wedge 32 and the bottle neck 36. Near the junction of the annular top wall 18 and the first cylindrical wall 22, the wall thickness of the first cylindrical wall 22 is at its thinnest, and for a typical 28 mm closure as shown here that thickness would be approximately 0.030 inch; the wall thickness of the second cylindrical wall 24 is typically 0.035 inch. In an unsealed position, as shown in FIG. 2, the annular wall 30 on a typical 28 mm closure of this invention would be disposed at an angle of approximately 20° to a horizontal plane, and the second cylindrical wall 24 would extend outwardly and downwardly from its junction with the central end wall 28 at an angle of approximately 5° with a vertical axis. As shown in FIG. 3, the forces resulting from the interference fit and a hinging action at the thin section 42 of the first cylindrical wall 22 cause an inward movement of the annular sealing wedge 32, decreasing the diameter of said wedge and generating a tight seal between the wedge 32 and inner surface of the bottle neck 36.

As the internal pressure from the carbonated beverage begins to increase, the annular wall 30 functions as a disc spring washer under this internal pressure, as will now be explained.

A disc spring washer, commonly known as a Belleville washer, has a frustoconical shape and is a well known device commonly used with a nut and bolt as a means for maintaining pressure on an assembly. Typically, a bolt would pass through the washer with the convex side of the washer adjacent to the bolt head, and the concave side of the washer bearing against the assembly being made with the bolt and washer. On the threaded end of the bolt, another Belleville washer might be inserted with the concave side against the assembly, and the convex side adjacent a nut. As the nut is tightened on the bolt, the respective faces of the bolt and nut bearing upon the outer periphery of said washers tend to flatten said washers causing the outside diameters of the washers to increase and impart a spring-like pressure between the assembly and the respective nut and bolt head.

In order for an annular wall 30 on a closure of this invention to function as a disc spring, said annular wall 30 must be disposed at an optimum angle with a horizontal plane for a given thickness of said annular wall 30. To satisfy structural requirements of a 28 mm closure of this invention to be used on a pressurized beverage bottle, based on the physical properties of the preferred materials, the preferred thickness of the annular wall 30 was determined to be 0.060 inch, and for that particular thickness, the optimum angle of the annular wall 30 in relation to a horizontal plane is approximately 20°. For other thicknesses of the annular wall 30 which might be desirable to satisfy different structural requirements, the optimum angle of the annular wall 30 in relation to a horizontal plane would be within a range of 10° to 30°.

Referring to FIG. 2, dotted lines are shown to indicate the junction between the upper surface 33 of the annular wall 30 and the bottom edges of the first and second cylindrical walls 22 and 24, and it can be seen that the outermost periphery of the upper surface of said wall 30 is coincident with the outermost point of the sealing wedge 32. It was determined by testing that the location of the outermost point of the sealing wedge 32 coincided with the outermost periphery of the upper surface 33 of the annular wall 30 in order to achieve the most effective seal under internal pressure.

Referring to FIG. 3, the internal pressure from the carbonated beverage acts against the interior surface of the circular end wall 26 causing said end wall to become slightly convex giving visual evidence of an effective seal. Said internal pressure also causes a force to be transmitted through the second cylindrical wall 24 to the inner periphery of the annular wall 30 at the junction of the second cylindrical wall 24 and the annular wall 30. The annular wall 30 reacts to said force in the same manner as the aforementioned Belleville washer. The angle between the horizontal and the annular wall 30 decreases, and the annular sealing wedge 32 is compressed tighter against the interior surface of the bottle neck 36.

Evidence of increased compression of the annular sealing wedge 32 when the container is pressurized is supported by data from a series of simulated pressure tests of closures of this invention. The tests were performed by restraining the annular end wall 18 in a vertical direction, applying upward vertical loads of varying amounts to the interior surface of the circular end wall 26 and measuring the outside diameter of the unrestrained annular sealing wedge as the closure was subjected to each of the various loads. The results of these tests are shown in Table 1.

Table 1

OUTSIDE DIAMETER OF ANNULAR SEALING WEDGE AT VARIOUS LOADS ON INTERIOR SURFACE OF CIRCULAR END WALL

| 0 | 40 lbs. | 75 lbs. |
|---|---|---|
| 0.879 | 0.881 | 0.884 |
| 0.879 | 0.879 | 0.881 |
| 0.879 | 0.880 | 0.881 |

It can be seen from the data that as the force on the circular end wall 26 increases, the outer diameter of the annular sealing wedge 32 also increases, and this movement would be translated into an increased compressive force if the annular sealing wedge were restrained from movement as it is in use within the neck of a pressurized bottle. Further, it can be seen that even should creep or cold flow of the plastic closure material occur, the annular wall 30 functioning under pressure in the same fashion as a Belleville washer will, through its junction with the first cylindrical wall 22, continue to maintain the annular sealing wedge 32 tightly compressed against the interior surface of the bottle neck 36.

When the bottle and closure are subjected to internal pressure, all exposed surfaces are acted upon, and a closure of this invention gains additional sealing capability from the pressure acting on surfaces other than the circular end wall 26. The combination of the generally horizontal pressure on the interior surface of the second cylindrical wall 24 and the generally upward pressure on the interior surface of the annular wall 30 contributes to maintaining the annular sealing wedge 32 compressed against the interior of the bottle neck 36. The combination of the sealing forces resulting from the interference fit as previously described and the internal pressure acting on the exposed surfaces of the closure tends to cause the point of the sealing wedge to flatten in compression against the interior of the bottle neck 36 and thus increase the sealing area. Under an internal pressure typical of carbonated beverages, the peripheral contact area between the closure and the bottle was measured and determined to be a circular band approximately 0.010 inches wide.

Figure 4:
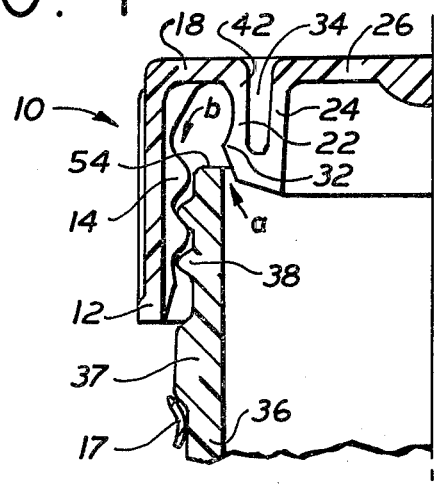
FIG. 4 is a partial cross section through the closure of FIG. 1 at the point of disengagement from a plastic bottle under internal pressure.

Referring now to FIG. 4, a half section of closure 10 is shown just as a portion of the annular sealing wedge 32 has cleared the top annular surface 54 of the bottle neck 36. The pilfer-proof means 17 has separated from the closure 10 and remains encircled around the bottle neck 36 below an annular ledge portion 37. The thread 14 of the closure 10 is still partially engaged with thread 38 of bottle neck 36, but a small gap is generated between the sealing wedge 32 and the top annular surface 54 of the bottle neck 36. The pressurized gas from within the bottle escapes through the aforementioned gap as indicated by arrow "a" into the void area between the first cylindrical wall 22 and skirt wall 12, and then through slot 20 in skirt wall 12 as indicated by arrow "b". The slot 20 is preferably 0.150 inch wide and extends downward from the top annular wall 18 to the bottom of the skirt wall 12. The preferred depth of the slot in a 28 mm closure of this invention is 0.015 inch outward of the root of the thread in the skirt wall 12; cutting the slot deeper than the root of the thread insures escape of the released gas to the atmosphere. More than one vent slot may be used in a closure of this invention, but it is desirable that at least one such slot be located at the point of first gas release from the interior of the bottle into the void space between the skirt wall 12 and the first circular wall 20. In this preferred embodiment, this point is 245° from the start of thread 14 (FIG. 3) in skirt wall 12. As the closure is unscrewed, the internal pressure tends to cock the closure in an upward direction at the point where the first disengagement occurs between the closure thread 14 and bottle thread 38. By locating the gas vent slot 20 at the point previously described, the gas has the shortest distance to travel for release to the atmosphere and provides the greatest safeguard against blow-off or missiling of the closure.

What is claimed is:

1. A linerless plastic closure adapted to seal a container comprising:

a closure skirt with closure retaining means on the interior surface thereof;

an annular top wall extending inwardly from the top of the closure skirt;

a first cylindrical wall extending downwardly from the inner edge of said annular top wall;

a second annular wall extending inwardly and downwardly from the bottom edge of said first cylindrical wall at an angle from 10° to 30° with a horizontal plane;

an outwardly projecting sealing wedge defined by a bottom portion of said first cylindrical wall and an upper portion of said second annular wall to provide a narrow sealing contact band when said closure is applied to said container;

a second cylindrical wall extending upwardly from a bottom portion of said second annular wall; and a circular central end wall closing the upper end of said second cylindrical wall.

2. A closure as set forth in claim 1 in which said second annular wall is disposed at approximately a 20° angle to a horizontal plane.

3. A closure as set forth in claim 1 in which said second annular wall has a beveled outer circumferential face of approximately 25°.

4. A closure as set forth in claim 1 in which said second annular wall has a width of approximately 0.060 inch.

5. A closure as set forth in claim 1 wherein said closure skirt has a pilfer-proof means.

6. A closure as set forth in claim 1 in which the closure retaining means is a screw thread, and portions of said closure skirt and screw thread define at least one axially extending vent slot across the screw threads at a point approximately 245° along the thread from the starting point of the thread.

7. A linerless plastic closure adapted to seal a container comprising:

an exterior skirt wall portion having closure retaining means on the interior thereof;

an annular planar top wall portion projecting radially inward from the top edge of said exterior skirt wall;

a first cylindrical wall substantially parallel to said exterior skirt wall depending downwardly from the inner edge of said annular top wall portion;

a central cup portion having a circular, planar center wall portion and a tubular wall portion substantially parallel to the first cylindrical wall and depending downwardly from the outer peripheral edge of said center wall portion;

a disc spring washer having a beveled outer edge connecting the bottom edges of said first cylindrical wall and said tubular wall portion, said spring washer extending downwardly and inwardly from said first cylindrical wall at an angle from 10° to 30° with a horizontal plane; and an annular outwardly projecting sealing wedge comprising an outer portion of said circular ring disc and a bottom portion of said first cylindrical wall to provide a narrow sealing contact band when applied to a container.

8. A linerless plastic closure adapted to seal a container comprising:

a cap having an annular planar ring top wall and a depending outer skirt wall with closure retaining means on the interior surfaces thereof;

a central plug having a circular disc center portion;

a first tubular wall depending downwardly from the peripheral edge of said center portion;

a circular, beveled disc spring washer extending radially outward and upward from the bottom edge of said tubular wall at an angle of 10° to 30° with a horizontal plane, said washer having a beveled outer edge;

a second tubular wall support depending downwardly from the inner edge of said annular planar ring top wall and connected to an outer portion of said disc spring washer; and a sealing wedge comprising a portion of said second tubular support wall and an outer portion of said disc spring washer to provide a narrow sealing contact band when applied to a container.

9. In combination, a bottle having a hollow, cylindrical mouth portion with closure retaining means thereon and a plastic closure sealed on the container mouth; the closure comprising a cylindrical skirt with means therein securing it on said closure retaining means, a first annular wall connecting said skirt with a central sealing plug portion which includes inner and outer substantially parallel tubular wall portions extending into the container mouth with a second annular wall inclined outwardly and upwardly at an angle from 10° to 30° with a horizontal plane interconnecting the innermost ends of the tubular walls, and a sealing wedge around said plug at the junction of said outer tubular wall and said second annular wall to provide a narrow sealing contact band when resiliently sealed against the interior surface of the container mouth by radial expansion of said sealing wedge caused by pressure in the container against said plug.

10. A combination as set forth in claim 9 in which the closure retaining means on the said container and closure are so disposed and dimensioned with respect to the closure plug that during removal of the closure from the container, the sealing wedge on the closure plug releases its seal against the container mouth before the closure retaining means on the closure skirt completely disengages the closure retaining means on the container to thereby prevent blow-off of the closure during such removal.

11. A combination as set forth in claim 10 in which portions of the closure skirt and closure retaining means define at least one axially extending slot across the closure retaining means in its skirt for passage of gases from the container during removal of the closure from the container.

* * * * *